US008919351B1

(12) United States Patent
Wang

(10) Patent No.: US 8,919,351 B1
(45) Date of Patent: Dec. 30, 2014

(54) MASCARA WAND ASSEMBLY

(71) Applicant: Ya-Tsan Wang, HsinChu (TW)

(72) Inventor: Ya-Tsan Wang, HsinChu (TW)

(73) Assignee: Derjin (Hong Kong) Holding Company Limited, Central (HK)

( * ) Notice: Subject to any disclaimer, the term of this patent is extended or adjusted under 35 U.S.C. 154(b) by 0 days.

(21) Appl. No.: 14/155,328

(22) Filed: Jan. 14, 2014

(51) Int. Cl.
*A45D 40/26* (2006.01)

(52) U.S. Cl.
CPC ..... *A45D 40/265* (2013.01); *A46B 2200/1046* (2013.01); *A46B 2200/106* (2013.01); *A46B 2200/1053* (2013.01)
USPC ..... 132/218

(58) Field of Classification Search
USPC ..... 132/218; 401/126–131
See application file for complete search history.

(56) References Cited

U.S. PATENT DOCUMENTS

| | | | | |
|---|---|---|---|---|
| 2,496,010 | A * | 1/1950 | Lotters | 15/201 |
| 3,968,536 | A * | 7/1976 | Leighton et al. | 15/187 |
| 4,257,434 | A * | 3/1981 | Wahl | 132/118 |
| 6,260,558 | B1 * | 7/2001 | Neuner | 132/218 |
| 6,345,626 | B1 * | 2/2002 | Bouix | 132/218 |
| 6,591,842 | B2 * | 7/2003 | Gueret | 132/218 |
| 7,930,793 | B2 * | 4/2011 | Stydahar | 15/201 |
| 8,091,562 | B2 * | 1/2012 | Manici et al. | 132/218 |
| 2002/0059942 | A1 * | 5/2002 | Neuner et al. | 132/218 |
| 2007/0062552 | A1 * | 3/2007 | De Brouwer et al. | 132/218 |
| 2009/0120452 | A1 * | 5/2009 | Rebours | 132/218 |
| 2010/0037911 | A1 * | 2/2010 | Kim | 132/218 |
| 2014/0105667 | A1 * | 4/2014 | Castex et al. | 401/129 |

FOREIGN PATENT DOCUMENTS

WO WO 2009048244 A1 * 4/2009

* cited by examiner

*Primary Examiner* — Robyn Doan
(74) *Attorney, Agent, or Firm* — C. G. Mersereau; Nikolai & Mersereau, P.A.

(57) ABSTRACT

A mascara wand assembly includes a wand, multiple brush units and a cylindrical brush unit. The wand has a cap and a handle on two ends thereof. The cylindrical brush unit is connected to the cap. The multiple brush units are mounted to the wand and each brush unit has multiple first brush hairs extending radially and outward therefrom. The first brush hairs have different thicknesses. Each first brush hair has multiple sub-brush hairs extending therefrom. Each brush unit has a notch and a block respectively on the top and underside thereof. A 90-degree angle is defined between the notch and block of each brush unit. The block of one brush unit is engaged with the notch of the next brush unit.

12 Claims, 9 Drawing Sheets

MASCARA WAND ASSEMBLY

BACKGROUND OF THE INVENTION (1) Fields of the Invention

The present invention relates to a mascara wand assembly, and more particularly, to a mascara wand assembly with adjustable brush units.

(2) Descriptions of Related Art

Mascara wands are used to curl the eyelashes to make the eyes be more attractive and vigorous. Eyes with thick, long and curly eyelashes not only give the users with confidence and also show the personal characters. The users use different types of mascara wands to have lush eyelashes which increase the cosmetic value and the lush eyelashes are an attractive focus to people so that the mascara wands are one of the important cosmetic tools.

The conventional mascara wands generally have a handle and a brush unit which has multiple brush hairs. The users use the brush hairs to spread the mascara onto the eyelashes and to curl and extend the eyelashes. However, the brush unit of the conventional mascara wand cannot be adjustable so that the width and/or arrangement of the brush hairs may not meet the user's need.

An improve mascara wand is developed which has multiple brush units on the wand and each brush unit has brush hairs connected thereto. The brush units can be movable and adjustable along the wand so that the user can collect all of the brush units together or separate the brush units to adjust the area that the brush hairs can reach. The improved mascara wand is designed to meet the different needs of the users and the mascara cans that cooperated with the mascara wand. However, the brush units are not secured properly and may shift to one position and affect the convenience of use.

The present invention intends to provide a mascara wand assembly which improves the shortcomings mentioned above.

SUMMARY OF THE INVENTION

The present invention relates to a mascara wand assembly and comprises a wand having a cap and a handle on two ends thereof. Multiple brush units are mounted to the wand and each brush unit has multiple first brush hairs extending radially and outward therefrom. Each first brush hair has multiple sub-brush hairs extending therefrom. Each brush unit has a notch defined in the top thereof, and a block extending downward from the underside thereof. An angle of 90-degree is defined between the notch and block of each brush unit. The block of one brush unit is engaged with the notch of another brush unit next to it. A cylindrical brush unit is mounted to the wand and connected to the cap. The cylindrical brush unit has an insertion extending downward from the underside thereof. The insertion is engaged with the notch of the brush unit next to the cylindrical brush unit. The cylindrical brush unit has multiple second brush hairs extending radially and outward therefrom.

The primary object of the present invention is to provide a mascara wand assembly which has multiple brush units mounted to the wand. Each brush unit has a positioning device so that the brush units are engaged with each other or separated from each other along the wand.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
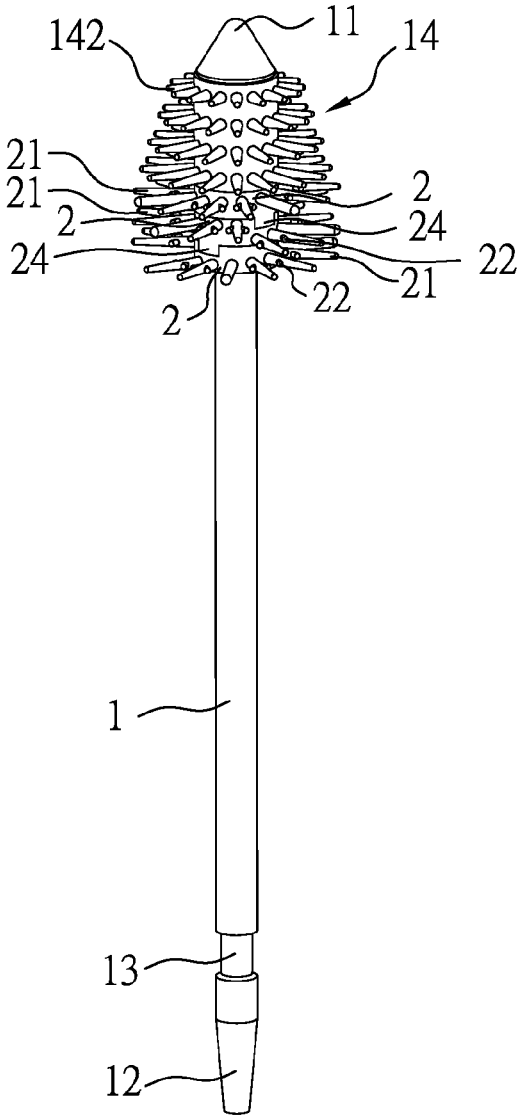
FIG. 1 is a perspective view to show the mascara wand assembly of the present invention.
Figure 2:
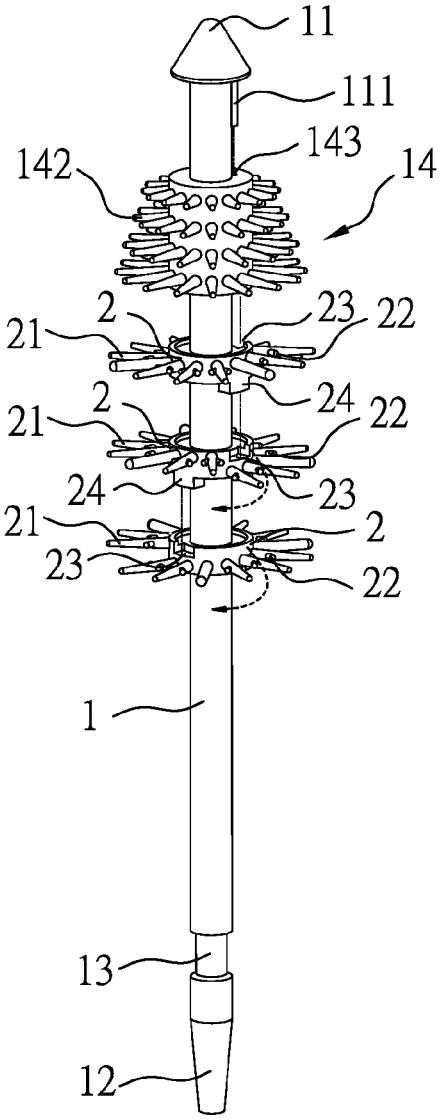
FIG. 2 is an exploded view of the mascara wand assembly of the present invention.

Referring to FIGS. 1 and 2, the mascara wand assembly of the present invention comprises a wand 1 having a cap 11 and a handle 12 on two ends thereof. The cap 11 is a cone-shaped cap and has a first positioning portion 111 extending therefrom which is a protrusion. An annular groove 13 is defined in the wand 1 and located close to the handle 12.

Figure 3:
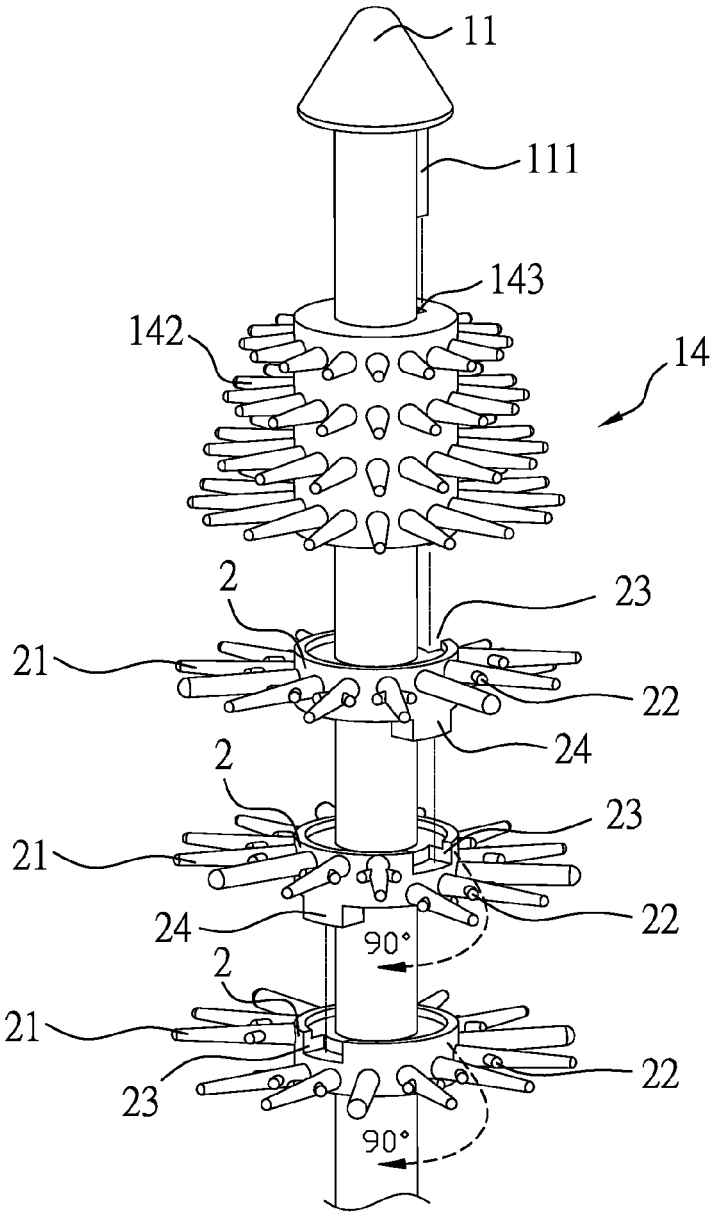
FIG. 3 is an enlarged view of the mascara wand assembly of the present invention.

Multiple brush units 2 are mounted to the wand 1 and each brush unit 2 is a disk-like unit and has multiple first brush hairs 21 extending radially and outward therefrom. The first brush hairs 21 have different thicknesses. Each first brush hair 21 has multiple sub-brush hairs 22 extending therefrom which have different thicknesses. Each brush unit 2 has a notch 23 defined in the top thereof, and each brush unit 2 has a block 24 extending downward from the underside thereof. An angle of 90-degree is defined between the notch 23 and block 24 of each brush unit 2. As shown in FIG. 3, the block 24 of one brush unit 2 is engaged with the notch 23 of another brush unit 2 next to it. When one brush unit 2 is to be connected to another, the brush unit 2 has to be rotated op degrees so as to align the block 24 and the notch 23. The first brush hairs 21 of the multiple brush units 2 are arranged as a spiral form along the wand 1.

Figure 3A:
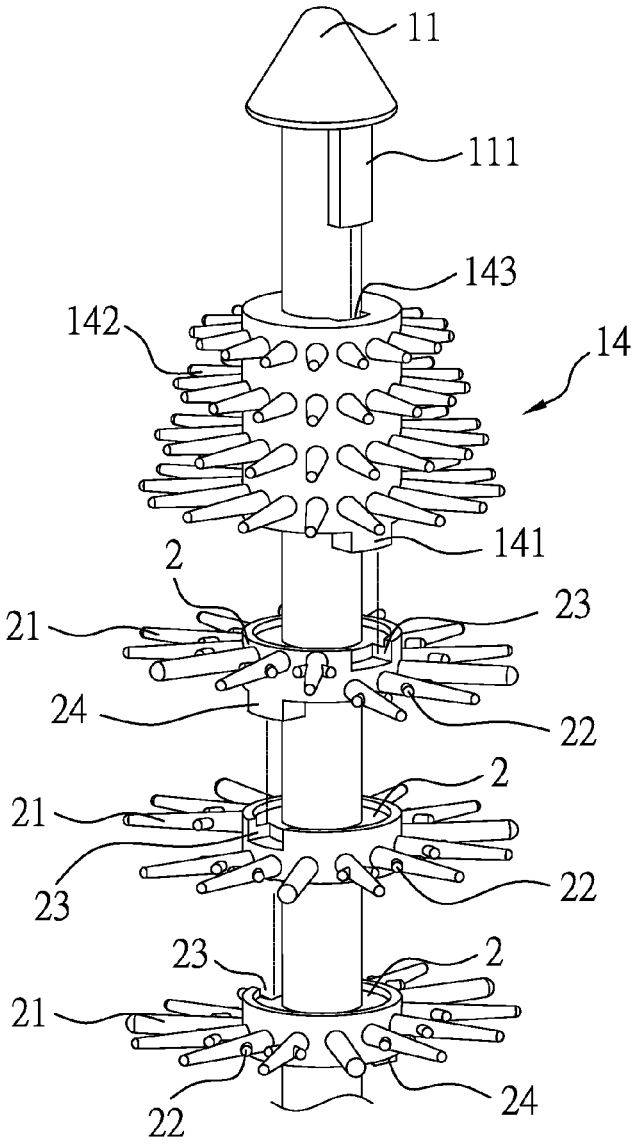
FIG. 3A shows that the cylindrical brush unit is to be connected to the cap of the mascara wand assembly of the present invention.

As shown in FIG. 3A, a cylindrical brush unit 14 is mounted to the wand 1 and has a second positioning portion 143 which is engaged with the first positioning portion 111 of the cap 11. In this embodiment, the second positioning portion 143 is a recess with which the first positioning portion 111 is engaged so as to connect the cylindrical brush unit 14 to the cap 11. The cylindrical brush unit 14 has an insertion 141 extending downward from the underside thereof. The insertion 141 is engaged with the notch 23 of the brush unit 2 next to the cylindrical brush unit 14. The insertion 141 is shaped to be engaged with the notch 23 of the brush unit 2. The cylindrical brush unit 14 has multiple second brush hairs 142 extending radially and outward therefrom.

Figure 4:
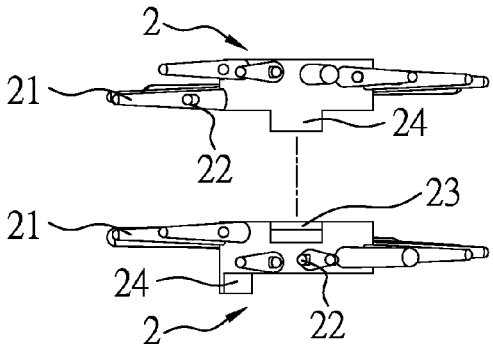
FIG. 4 shows the first embodiment of the brush units of the mascara wand assembly of the present invention.
Figure 5:
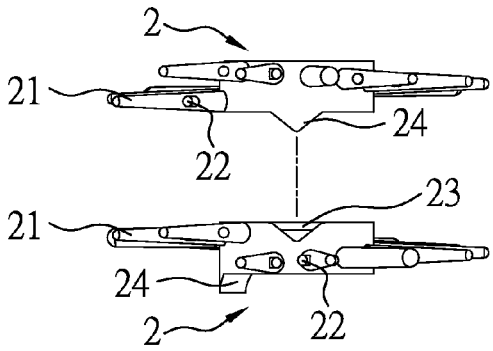
FIG. 5 shows the second embodiment of the brush units of the mascara wand assembly of the present invention.
Figure 6:
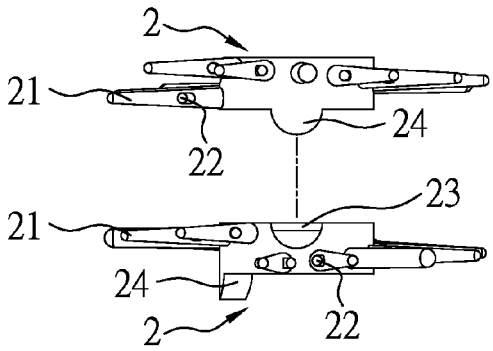
FIG. 6 shows the third embodiment of the brush units of the mascara wand assembly of the present invention.
Figure 7:
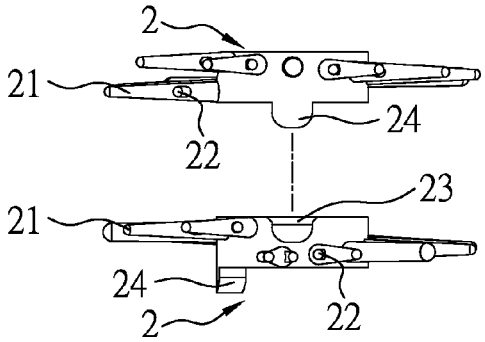
FIG. 7 shows the fourth embodiment of the brush units of the mascara wand assembly of the present invention.

As shown in FIG. 4, the first embodiment shows that the notch 23 and the block 24 of each brush unit 2 are rectangular. As shown in FIG. 5, the second embodiment shows that the notch 23 and the block 24 of each brush unit 2 are V-shaped. As shown in FIG. 6, the third embodiment shows that the notch 23 and the block 24 of each brush unit 2 are semi-circular. As shown in FIG. 7, the fourth embodiment shows that the notch 23 and the block 24 of each brush unit 2 are U-shaped.

Figure 8:
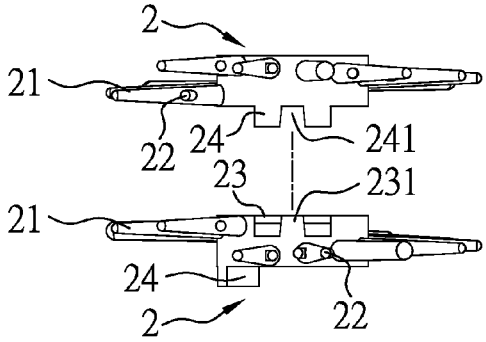
FIG. 8 shows the fifth embodiment of the brush units of the mascara wand assembly of the present invention.
Figure 9:
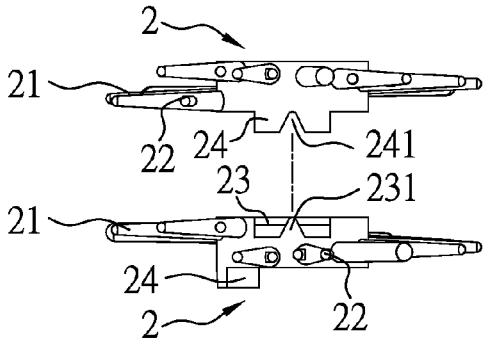
FIG. 9 shows the sixth embodiment of the brush units of the mascara wand assembly of the present invention.
Figure 10:
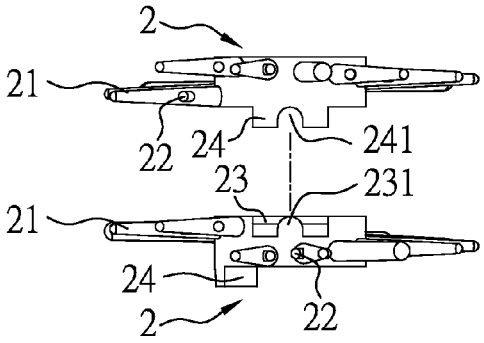
FIG. 10 shows the seventh embodiment of the brush units of the mascara wand assembly of the present invention.
Figure 11:
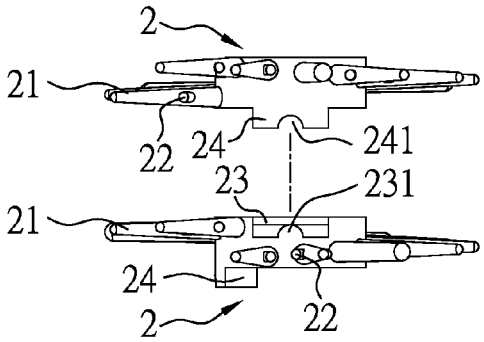
FIG. 11 shows the eighth embodiment of the brush units of the mascara wand assembly of the present invention.

As shown in FIG. 8, the fifth embodiment shows that the notch 23 has a protrusion 231 protruding therefrom and the block 24 has a recess 241 which is located corresponding to the protrusion 231. The protrusion 231 is a rectangular protrusion and the recess 241 is a rectangular recess. The protrusion 231 is engaged with the recess 241. As shown in FIG. 9, the sixth embodiment shows that the protrusion 231 and the recess 241 are V-shaped. As shown in FIG. 10, the seventh embodiment shows that the protrusion 231 and the recess 241 are U-shaped. As shown in FIG. 11, the eighth embodiment shows that the protrusion 231 and the recess 241 are semi-circular.

Figure 12:
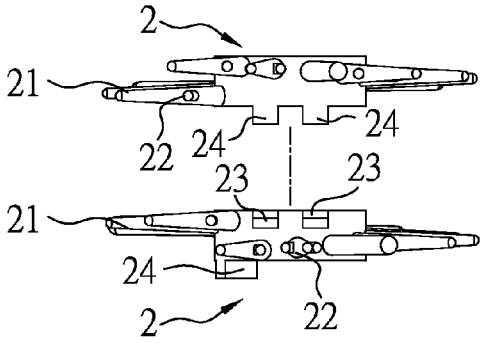
FIG. 12 shows the ninth embodiment of the brush units of the mascara wand assembly of the present invention.
Figure 13:
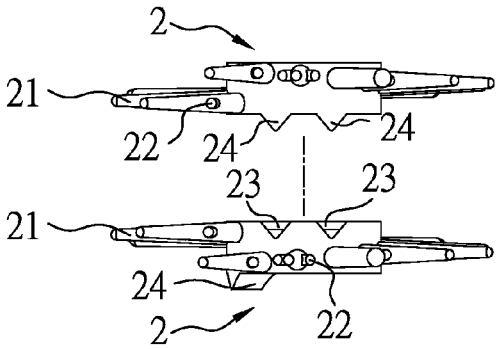
FIG. 13 shows the tenth embodiment of the brush units of the mascara wand assembly of the present invention.
Figure 14:
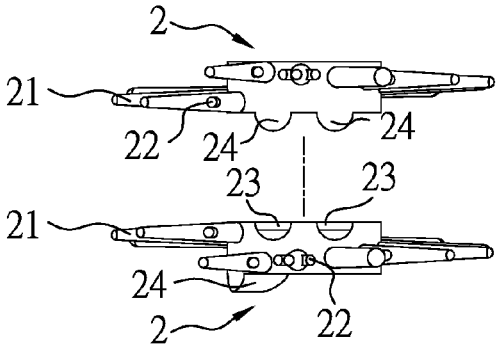
FIG. 14 shows the eleventh embodiment of the brush units of the mascara wand assembly of the present invention.
Figure 15:
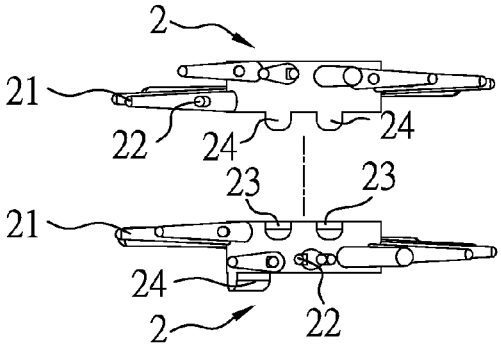
FIG. 15 shows the twelfth embodiment of the brush units of the mascara wand assembly of the present invention.
Figure 16:
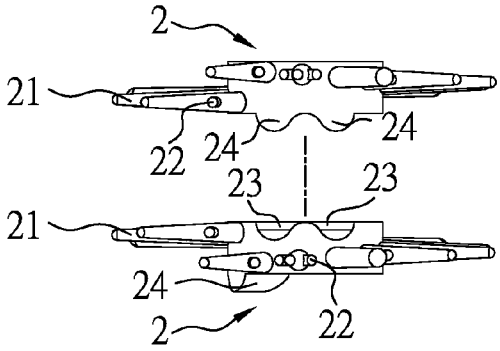
FIG. 16 shows the thirteenth embodiment of the brush units of the mascara wand assembly of the present invention.

As shown in FIG. 12, the ninth embodiment shows that each brush unit 2 has multiple notches 23 defined in the top thereof, and each brush unit 2 has multiple blocks 24 on the underside thereof. An angle of 90-degree is defined between the notches 23 and the blocks 24. The notches 23 of one brush unit 2 are engaged with the blocks 24 of another brush unit next to it. The notches 23 and the blocks 24 are twin-rectangular. FIG. 13 shows the tenth embodiment wherein the notches 23 and the blocks 24 of each brush unit 2 are twin-V-shaped. FIG. 14 shows the eleventh embodiment wherein the notches 23 and the blocks 24 of each brush unit 2 are twin-semi-circular. FIG. 15 shows the twelfth embodiment wherein the notches 23 and the blocks 24 of each brush unit 2 are twin-U-shaped. FIG. 16 shows the thirteenth embodiment wherein the notches 23 and the blocks 24 of each brush unit 2 are wave-shaped.

Figure 17:
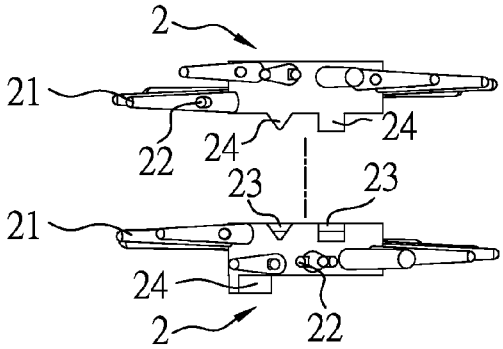
FIG. 17 shows the fourteenth embodiment of the brush units of the mascara wand assembly of the present invention.
Figure 18:
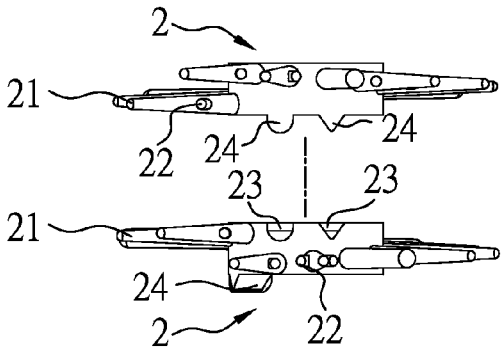
FIG. 18 shows the fifteenth embodiment of the brush units of the mascara wand assembly of the present invention.
Figure 19:
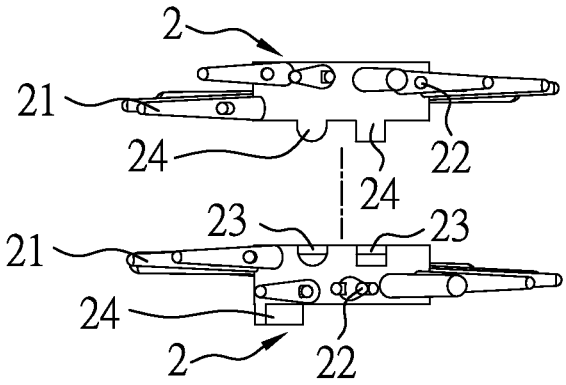
FIG. 19 shows the sixteenth embodiment of the brush units of the mascara wand assembly of the present invention.

FIG. 17 shows the fourteenth embodiment, wherein each brush unit 2 has multiple notches 23 defined in the top thereof, and each brush unit 2 has multiple blocks 24 on the underside thereof. The notches 23 are V-shaped and rectangular, and the blocks 24 are V-shaped and rectangular. The blocks 24 and the notches 23 that have the same shape are engaged with each other. FIG. 18 shows the fifteenth embodiment, wherein the multiple notches 23 and the multiple blocks 24 are V-shaped and U-shaped respectively. FIG. 19 shows the sixteenth embodiment, wherein the multiple notches 23 and the multiple blocks 24 are rectangular and U-shaped respectively.

While we have shown and described the embodiment in accordance with the present invention, it should be clear to those skilled in the art that further embodiments may be made without departing from the scope of the present invention.

What is claimed is:

1. A mascara wand assembly comprising:

a wand having a cap and a handle on two ends thereof;

multiple brush units mounted to the wand and each brush unit having multiple first brush hairs extending radially and outward therefrom, each first brush hair having multiple sub-brush hairs extending therefrom, each brush unit having a notch defined in a top thereof, each brush unit having a block extending downward from an underside thereof, a 90-degree angle being defined between the notch and block of each brush unit, the block of one brush unit being engaged with the notch of another brush unit next to it, and a cylindrical brush unit mounted to the wand and connected to the cap, the cylindrical brush unit having an insertion extending downward from an underside thereof, the insertion being engaged with the notch of the brush unit next to the cylindrical brush unit, the cylindrical brush unit having multiple second brush hairs extending radially and outward therefrom.

2. The mascara wand assembly as claimed in claim 1, wherein the first brush hairs have different thicknesses.

3. The mascara wand assembly as claimed in claim 1, wherein the sub-brush hairs have different thicknesses.

4. The mascara wand assembly as claimed in claim 1, wherein the notch and the block of each brush unit are either rectangular, V-shaped, semi-circled, or U-shaped.

5. The mascara wand assembly as claimed in claim 1, wherein the notch has a protrusion protruding therefrom and the block has a recess which is located corresponding to the protrusion, the protrusion is engaged with the recess.

6. The mascara wand assembly as claimed in claim 5, wherein the protrusion and the recess are either rectangular, V-shaped, semi-circular, or U-shaped.

7. The mascara wand assembly as claimed in claim 1, wherein each of the brush units has multiple notches and blocks.

8. The mascara wand assembly as claimed in claim 7, wherein the notches and the blocks of each brush unit are either twin-rectangular, twin-V-shaped, or twin-U-shaped.

9. The mascara wand assembly as claimed in claim 7, wherein the notches and the blocks of each brush unit are wave-shaped.

10. The mascara wand assembly as claimed in claim 7, wherein the notches and the blocks of each brush unit are V-shaped and rectangular respectively, rectangular and U-shaped respectively, or V-shaped and U-shaped respectively, the shape of the blocks of one brush unit is the same as that of the notches of another brush unit next to it.

11. The mascara wand assembly as claimed in claim 1, wherein the first brush hairs of the brush units are arranged as a spiral form along the wand.

12. The mascara wand assembly as claimed in claim 1, wherein the cap has a first positioning portion and the cylindrical brush unit has a second positioning portion, the first positioning portion is engaged with second positioning portion to position the cylindrical brush unit.

* * * * *